US009631490B2

(12) United States Patent
Latham

(10) Patent No.: US 9,631,490 B2
(45) Date of Patent: Apr. 25, 2017

(54) TOOTH AND RETAINER

(71) Applicant: Winchester E. Latham, Avon, IN (US)

(72) Inventor: Winchester E. Latham, Avon, IN (US)

( * ) Notice: Subject to any disclaimer, the term of this patent is extended or adjusted under 35 U.S.C. 154(b) by 0 days.

(21) Appl. No.: 14/817,116

(22) Filed: Aug. 3, 2015

(65) Prior Publication Data

US 2015/0337658 A1 Nov. 26, 2015

Related U.S. Application Data

(63) Continuation-in-part of application No. 13/975,704, filed on Aug. 26, 2013, now Pat. No. 9,238,893.

(51) Int. Cl.

| | |
|---|---|
| ***E21C 35/193*** | (2006.01) |
| ***E21C 25/10*** | (2006.01) |
| ***E21C 35/183*** | (2006.01) |
| ***B28D 1/18*** | (2006.01) |
| *E21C 35/19* | (2006.01) |

(52) U.S. Cl.

CPC ..... *E21C 35/1933* (2013.01); *B28D 1/188* (2013.01); *E21C 25/10* (2013.01); *E21C 35/183* (2013.01); *E21C 2035/191* (2013.01); *Y10T 29/49822* (2015.01)

(58) Field of Classification Search

CPC ..... B28D 1/188; B28D 1/186; B23C 5/2472; B23C 2210/168; B23C 5/2265; B02C 13/06; B23D 35/002; E01C 23/088; E21C 2035/191; E21C 25/10; E21C 35/1933; E21C 35/18

USPC ..... 299/39.1, 39.3, 39.4, 39.8, 87.1, 102, 299/103, 113

See application file for complete search history.

(56) References Cited

U.S. PATENT DOCUMENTS

| | | | | |
|---|---|---|---|---|
| 1,348,279 | A * | 8/1920 | Heywood | B23C 5/2437 144/230 |
| 1,681,675 | A * | 8/1928 | Miller | B23C 5/2455 407/36 |
| 1,951,101 | A * | 3/1934 | Miller | B23C 5/2455 407/36 |
| 2,257,169 | A * | 9/1941 | Hopps | B23C 5/2265 144/230 |
| 2,306,798 | A | 12/1942 | Benninghoff | |
| 2,547,789 | A * | 4/1951 | Skeel | B23C 5/2455 114/88 |
| 2,751,006 | A * | 6/1956 | Lane | B23D 35/002 101/409 |
| 3,574,251 | A | 4/1971 | Corti | |

(Continued)

*Primary Examiner* — John Kreck
*Assistant Examiner* — Carib Oquendo
(74) *Attorney, Agent, or Firm* — Brinks Gilson & Lione

(57) ABSTRACT

A milling drum adapted to be rotated in a cutting direction about an axis defined by the cylindrical surface of the drum. A plurality of pairs of overlapping recesses in the cylindrical surface of the drum. A tooth or cutting bit with a base configuration matching a first of the pair of the overlapping recesses, and a lower portion of a side surface including a retainer engagement feature. A retainer has a base configuration matching a second of the pair of overlapping recesses, and a side surface including a tooth engagement feature. A fastener secures the retainer in the second of the overlapping recesses so that the tooth engagement feature of the retainer engages the retainer engagement feature of the tooth or cutting bit to hold the tooth or cutting bit in the first of the overlapping recesses.

20 Claims, 8 Drawing Sheets

(56) References Cited

U.S. PATENT DOCUMENTS

| | | | | | |
|---|---|---|---|---|---|
| 4,009,742 | A | | 3/1977 | Ziegelmeyer | |
| 4,305,440 | A | * | 12/1981 | Lacasse | B23C 5/2437 144/230 |
| 4,880,278 | A | | 11/1989 | Tomlinson | |
| 5,066,180 | A | | 11/1991 | Lang et al. | |
| 5,240,192 | A | * | 8/1993 | Tilby | A01F 29/095 144/174 |
| 5,529,249 | A | | 6/1996 | Braun et al. | |
| 5,857,506 | A | | 1/1999 | Paolone | |
| 5,884,979 | A | | 3/1999 | Latham | |
| 6,427,791 | B1 | * | 8/2002 | Glowka | E21B 10/633 175/413 |
| 7,108,212 | B2 | | 9/2006 | Latham | |
| 7,290,726 | B2 | | 11/2007 | Latham | |
| 7,338,134 | B2 | | 3/2008 | Latham | |
| 7,637,574 | B2 | * | 12/2009 | Hall | E21C 35/183 299/104 |
| 2001/0045478 | A1 | | 11/2001 | Recker et al. | |
| 2005/0098015 | A1 | * | 5/2005 | Latham | E21C 35/1936 83/698.41 |
| 2008/0175686 | A1 | | 7/2008 | Wallek | |

* cited by examiner

TOOTH AND RETAINER

PRIORITY

This application is a continuation-in-part of U.S. patent application Ser. No. 13/975,704, filed Aug. 26, 2013, which is incorporated herein by reference.

BACKGROUND

This invention generally relates to the field of rotary driven cylindrical cutter devices and scarifiers for use in roadway surface milling. More particularly, the present invention is directed to tooth and retainer inserts for such rotary driven cylindrical cutter devices and scarifiers that can be used on equipment for modifying the surface of an existing road, and in particular, to equipment for smoothing areas of existing pavement by removing bumps, upward projections, and other surface irregularities, removing paint stripes, and milling shallow recessed to receive roadway edging and marking tape.

In general, roadway surface milling, planing, or reclaiming equipment disclosed in the prior art includes a rotary driven cylindrical comminuting drum which acts to scarify and to mine the top portion of the asphaltic road surface in situ. Road planning machines are used to remove bumps and other irregularities on the surface of a road, runway, taxiway, or other stretch of pavement. This planning effect is typically achieved by grinding the paved surface so that the grinding depth may vary slightly, but the surface produced by the grinding unit is more level than the original surface. The road planning machine typically includes a grinding unit that is powered by an engine or motor. A tractor is attached to, or integral with, the grinding unit for propelling the grinding unit against the paved surface in a desired direction.

In some prior art devices of this type, a plurality of cutter bit support members are connected by bolts or by a weld to the curved surface of a drum or to flighting fixed to a drum surface. The plurality of the support members can be arranged end-to-end so as to form a more or less continuous helical pattern. The top surface of the helically arranged support members may be elevated above the curved surface of the drum. The top surfaces of the cutter bit support members can include angled openings into which conventional cutter bits are received. The cutter bits can be a conical cutter with preferably a tungsten carbide tip or the like. The tip can have a variety of shapes.

One example of a cutter bit holder and drum is disclosed in U.S. Pat. No. 5,884,979 to Latham. Here, the drum surface omits any flighting, but includes a plurality of spaced recesses arranged in a preselected pattern, each recess being defined by a generally circular upper edge and including a bottom surface depressed below the driven member rotatable surface. Each cutting bit holding element has a body portion having at least one aperture receiving the cutting bit and a lower portion having a generally cylindrical outer surface sized to be received in only one of said recesses. The lower portion has a reference lower end abutting the recess bottom surface with a locating element engaging the cutting bit holder element lower end with a niche within said recess for orienting the cutting bit holder with respect to said cutting direction. When the cutting bit holding elements are situated within the recesses, they are secured in position by means of a weld line joining the cutting bit holding element to the surface of the drum in a line outside of the upper edge of each recess. In the event of wear or catastrophic failure of one or more of the cutting bit holding elements, the worn or failed element must be removed from the assembly. Replacement of the holding element requires the use of a cutting torch, and the welding of a new support member in place. This is a time-consuming repair job which results in considerable expense to a mining machine operation, and results in a decreased rate in mining.

Despite the availability of such devices, there exists a need in the art for an apparatus having a cutter bit insert for a milling drum, preferably without flighting, that is capable of removable attachment to the drum, yet is resistant to loosening upon rotation of the milling drum. There is also a need for a cutter bit a cutter bit having low profile above the drum so that the total diameter of the drum including cutter bits is less than about 18 inches. There is also a need for a cutter bit that can be quickly removed from the drum and replaced so that the down time experience during cutter bit replacement is minimized.

SUMMARY

A combination can be used on any selected portion of a milling or planning drum that preferably omits any flighting and is adapted to be rotated in a cutting direction about an axis defined by the cylindrical surface of the drum. The combination includes a plurality of pairs of overlapping recesses in the cylindrical surface of the drum. The combination can also include a tooth or cutting bit having a base configuration matching a first of the pair of the overlapping recesses, and a lower portion of a side surface including a retainer engagement feature. The combination can also include a retainer having a base configuration matching a second of the pair of overlapping recesses, and a side surface including a tooth engagement feature. A fastener can secure the retainer in the second of the pair of overlapping recesses so that the tooth engagement feature of the retainer engages the retainer engagement feature of the tooth or cutting bit.

The combination can include a drum wherein each of the pairs of overlapping recesses includes side surfaces that are parallel to each other. In a preferred embodiment, each of the pairs of overlapping recesses can be aligned along a circumference line extending around the cylindrical surface of the drum. The combination can also include a retainer engagement feature on the lower portion of a side surface of the tooth which comprises an inclined planar surface facing outwardly relative to the drum cylindrical surface. The combination can also include a tooth engagement feature on the retainer which comprises an inclined planar surface facing inwardly relative to the drum cylindrical surface. In a preferred embodiment, the inclined planar surface on the side surface of the tooth is angled to be abutted by the inclined planar surface of the retainer to lock the tooth into the first of the overlapping recesses in the drum.

The combination can also include a retainer wherein the fastener comprises a screw passing through the retainer so that the fastener is engaged into a threaded opening in the base of the second of the pair of overlapping recesses. In a preferred embodiment, the retainer includes a hole passing through the retainer in alignment with the threaded opening in the base of the second of the pair of overlapping recesses, the hole having a diameter greater than the threaded opening in the base, the hole having an internal engagement feature. The internal engagement feature of the hole in the retainer can be design to engage an extraction tool. The extraction tool can take the form of a slide hammer including a shaft and a slide weight, the shaft having an end adapted to engage the engagement feature of the hole in the retainer to pull the retainer and tooth from the overlapping recesses. Alternatively, the extraction tool can take the form of a threaded extraction screw having a diameter greater than the fastener diameter that engages the engagement feature of the hole in the retainer, so that an end of the extraction screw abuts a surface within the second of the pair of overlapping recesses to push the retainer and tooth from the overlapping recesses.

One feature of the apparatus is that the retainer can be sized to have an upper surface that is situated below the cylindrical surface of the drum when the retainer and tooth are fully engaged in the overlapping recesses. The feature has the advantage of substantially eliminating any wear on the sides of the retainer so that the retainer can be used repeatedly with new teeth or cutting bits, thereby lowering hardware replacement costs.

Another feature of the apparatus is that the upper end of the cutting bit or tooth can have any desired configuration, including a broad flat chisel point particularly suitable for roadway surface milling and planing equipment intended for modifying the surface of an existing road, and in particular, to equipment for smoothing areas of existing pavement by removing bumps, upward projections, and other surface irregularities. A particular advantage of this combination is the ability to form rotary driven cylindrical cutter devices of small diameter.

Another feature of the apparatus is that the threaded opening in the base receiving the retainer can be defined by a removable insert having internal threads designed to engage the fastener securing the retainer in place. The removable character of the insert ensures that the drum can quickly be refurbished in the field, if necessary, in the event of any damage to the fastener engaging threads.

Another feature of the apparatus relates to a member which projects orthogonally between an outer surface of at least one of the cutting bit base and the retainer base and the milling drum. The member rotationally retains a position of at least one of the cutting bit base or the retainer base with respect to milling drum.

These and other advantages of the disclosed combination will become readily apparent to those skilled in the art from the following detailed description of a preferred embodiment when considered in the light of the accompanying drawings.

DESCRIPTION OF EMBODIMENTS

Figure 1:
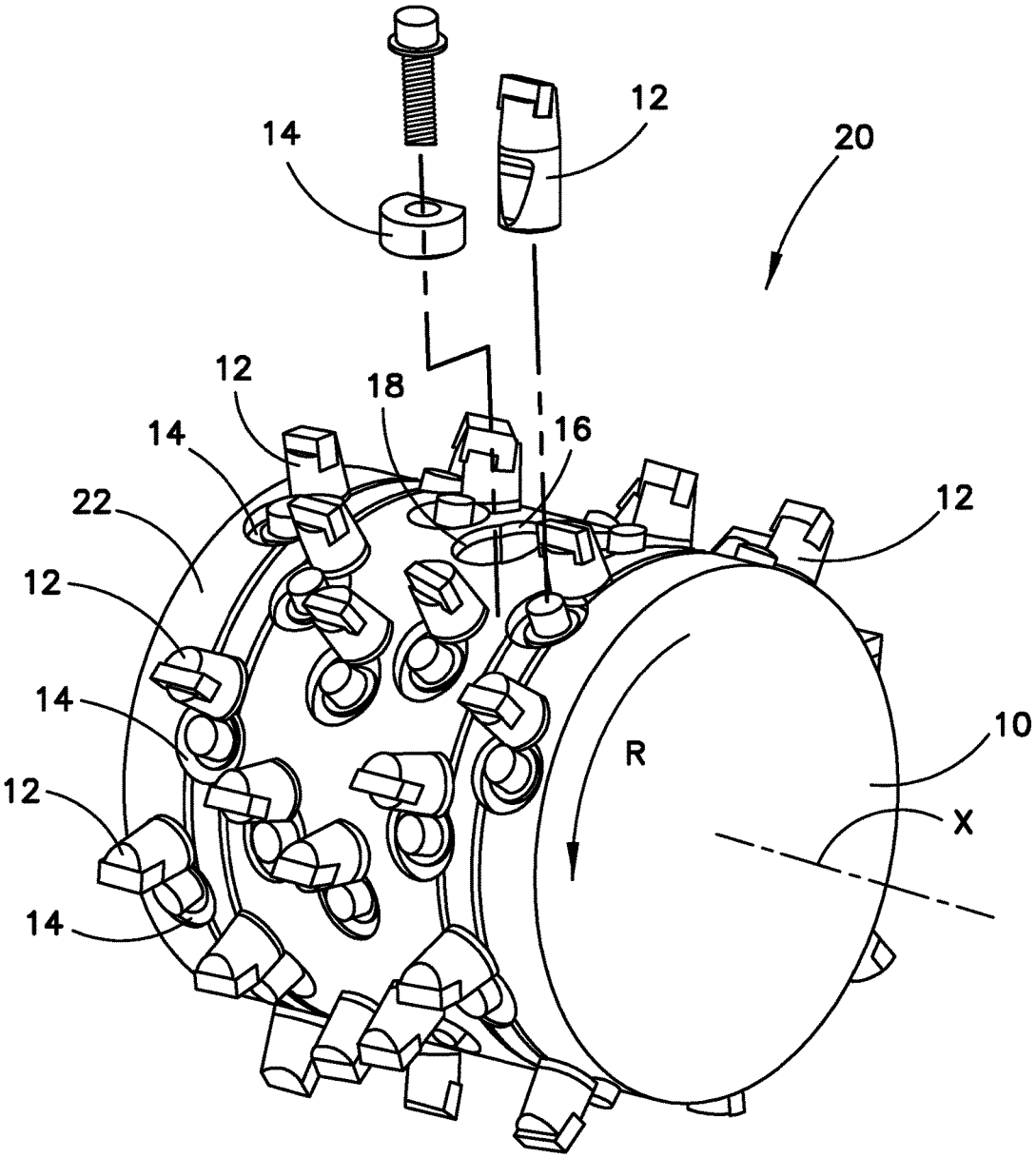
FIG. 1 is a perspective view of a drum having a plurality of cutting bit and retainer pairs received in overlapping recesses, one of the cutting bit and retainer pairs shown in exploded view.

With reference to all the drawings, the same reference numerals are generally used to identify like components. FIG. 1 is a perspective view of a drum 10 without flighting having a plurality of cutting bit 12 and retainer 14 pairs received in overlapping recesses 16, 18 in the drum 10. The recesses 16 and 18 are shown in FIG. 1 to consist of overlapping right cylindrical depressions into the drum 10. One of the cutting bit and retainer pairs is shown in exploded view to illustrate one embodiment of an apparatus 20. The cutting bit and retainer pairs can be used on any portion of a cylindrical surface 22 of a milling or mining drum 10, which is adapted to be rotated in a cutting direction R about a cylindrical axis X concentric to the drum surface 22.

Figure 2:
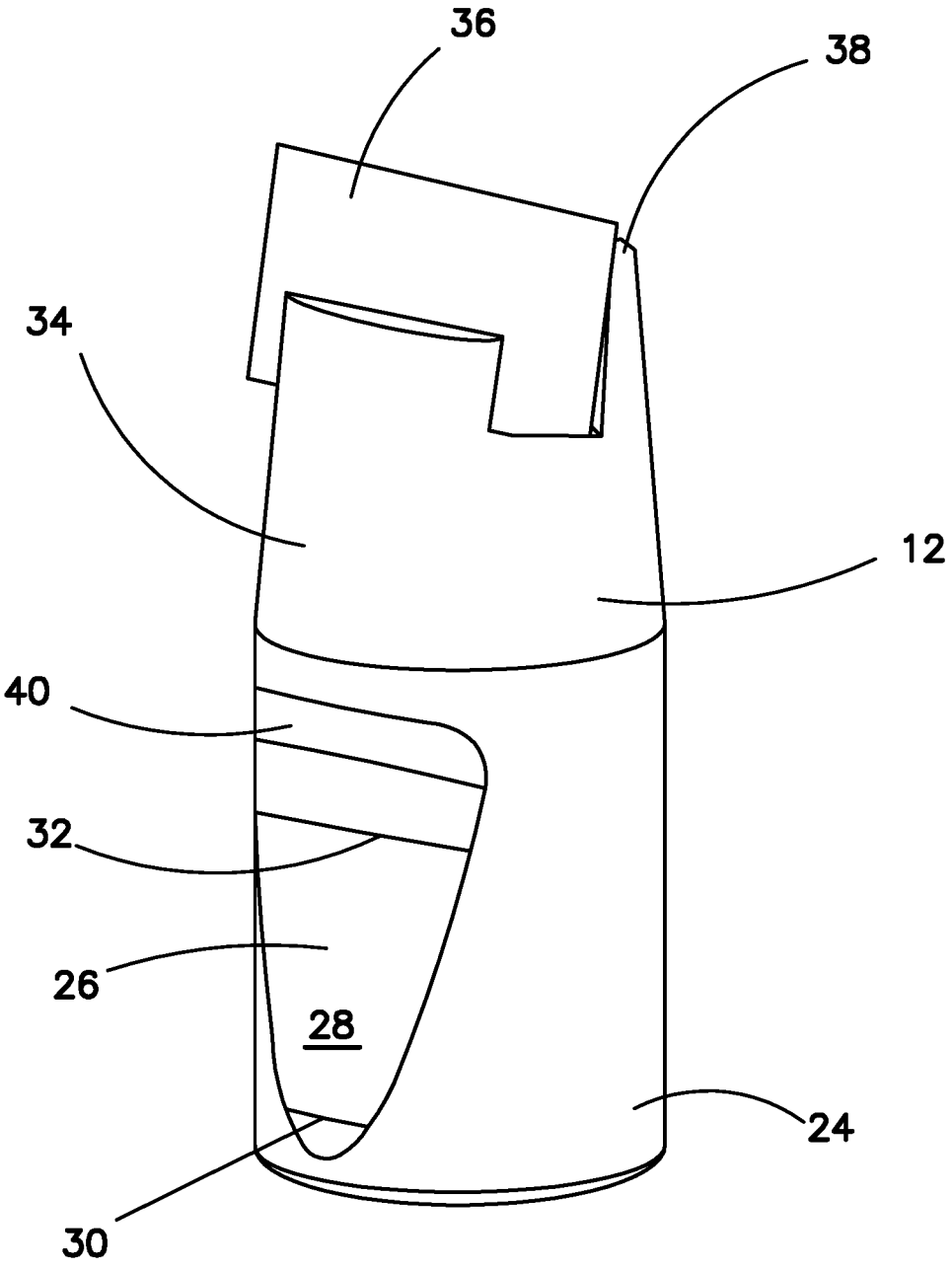
FIG. 2 is an enlarged, perspective view of one of the cutting bits showing a retainer engagement feature on a lower portion of the cutter bit.

One embodiment of the cutting bit 12 is shown in FIG. 2 to include a pedestal 24 that is shown to be generally cylindrical and includes a retainer engagement feature 26 on a lower portion thereof. The retainer engagement feature 26 is shown as a planar surface 28 that is inclined slightly upwardly so that a lower chord line 30 on the surface is shorter than a parallel upper chord line 32. The cutting bit 12 is also shown in FIG. 2 to include a upper portion 34 that is shown to be conically tapered, but the upper portion 34 can be a continuation of the shape of the pedestal 24. A cutting element 36 can be secured to protrude above an upper end 38 of the conically tapered upper portion. The cutting bit 12 is further shown in FIG. 2 to have an additional laterally extending surface 40 located immediately above the retainer engagement feature 26 that facilitates the removal of the cutting bit 12 from the drum 10 as described below.

Figure 3:
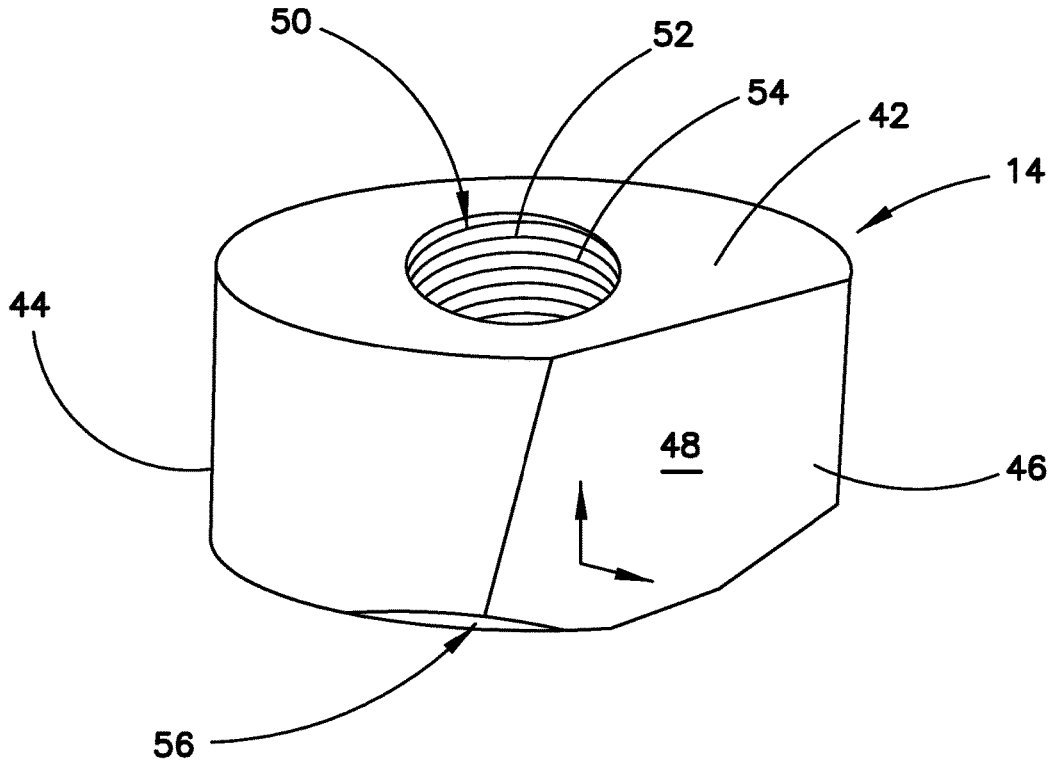
FIG. 3 is an enlarged, perspective view of one of the retainers showing a tooth engagement feature on a side thereof.

One embodiment of the retainer 14 is shown in FIG. 3 to include a planar upper surface 42 that is perpendicular to a right cylindrical side surface 44. A tooth engagement feature 46 occupies a portion of the side of the retainer 14 and is shown to consist of a planar surface 48 inclined slightly downwardly at an angle matching, but in the opposite direction of, planar surface 28 on cutting bit 12. The retainer 14 also includes a hole 50 passing through the retainer 14 perpendicular to the upper planar surface 42 and symmetrically positioned with respect to the right cylindrical side surface 44. The hole 50 can include an internal engagement feature 52, which can be a set of threads 54, adapted to engage a tool suitable for removing the retainer 14 from the drum 10 as discussed in more detail below. The retainer 14 also can include a tapered lower surface 56, which may be better see in FIG. 4.

Figure 4:
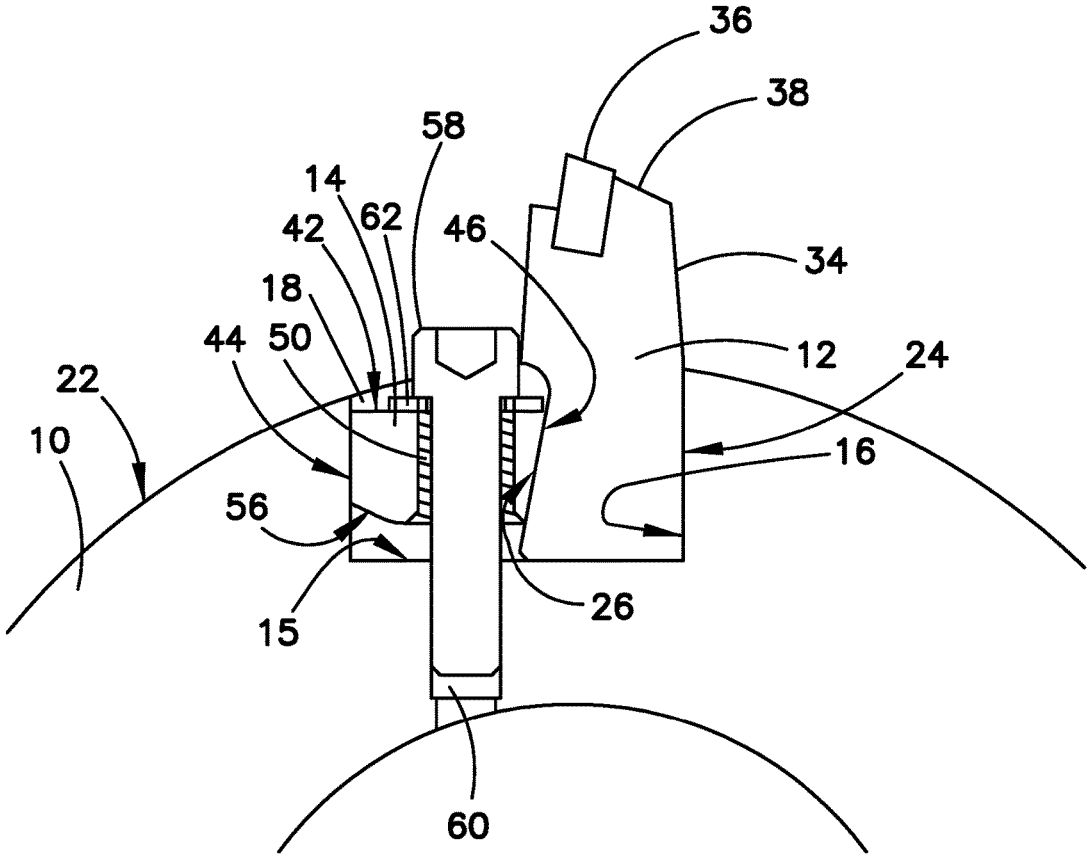
FIG. 4 is a sectional view of a drum with one of the cutting bit and retainer pairs received in overlapping recesses.

FIG. 4 is a sectional view of a drum 10 with one of a cutting bit 12 received in recess 16 and retainer 14 received in recess 18. The cylindrical pedestal portion 24, or base of the cutting bit 12 is shown to be dimensioned to match the size of the recess 16, while the upper portion 34 extends above the surface 22 of the drum 10. A base configuration of the cylindrical pedestal portion 24 is formed to be positioned to abut and be contiguously aligned with a bottom 15 or floor formed by the milling drum so that a cutting element 36 positioned at an upper end of the tooth or cutting bit 12 extends away from the cylindrical surface 22 to form a negative rake angle with respect to the cutting direction of the milling drum 10. The cylindrical side surface 44 of the retainer 14 is dimensioned to match the size of the recess 18, while the vertical dimension of the retainer is such that the planar upper surface 42 is recessed below the surface 22 of the drum 10. The tooth engagement feature 46 of the retainer 14 engages in an abutting arrangement the retainer engagement feature 26 of the tooth or cutting bit 12 to fixedly retain the tooth or cutting bit 12 in contiguous alignment with the floor 15. A fastener 58, which can be a screw, can secure the retainer 14 in the recess 18 so that the tooth engagement feature 46 engages the retainer engagement feature 26 to lock the cutting bit 12 in a desired position with respect to the drum surface 22. The fastener 58 is preferably of a smaller diameter than hole 50 so that the fastener passes freely through the hole to engage an opening 60 in the bottom 15 of recess 14. The fastener 58 can include a washer 62 to provide a broad bearing surface on the top of the planar upper surface 42 of the retainer 14.

Figure 5:
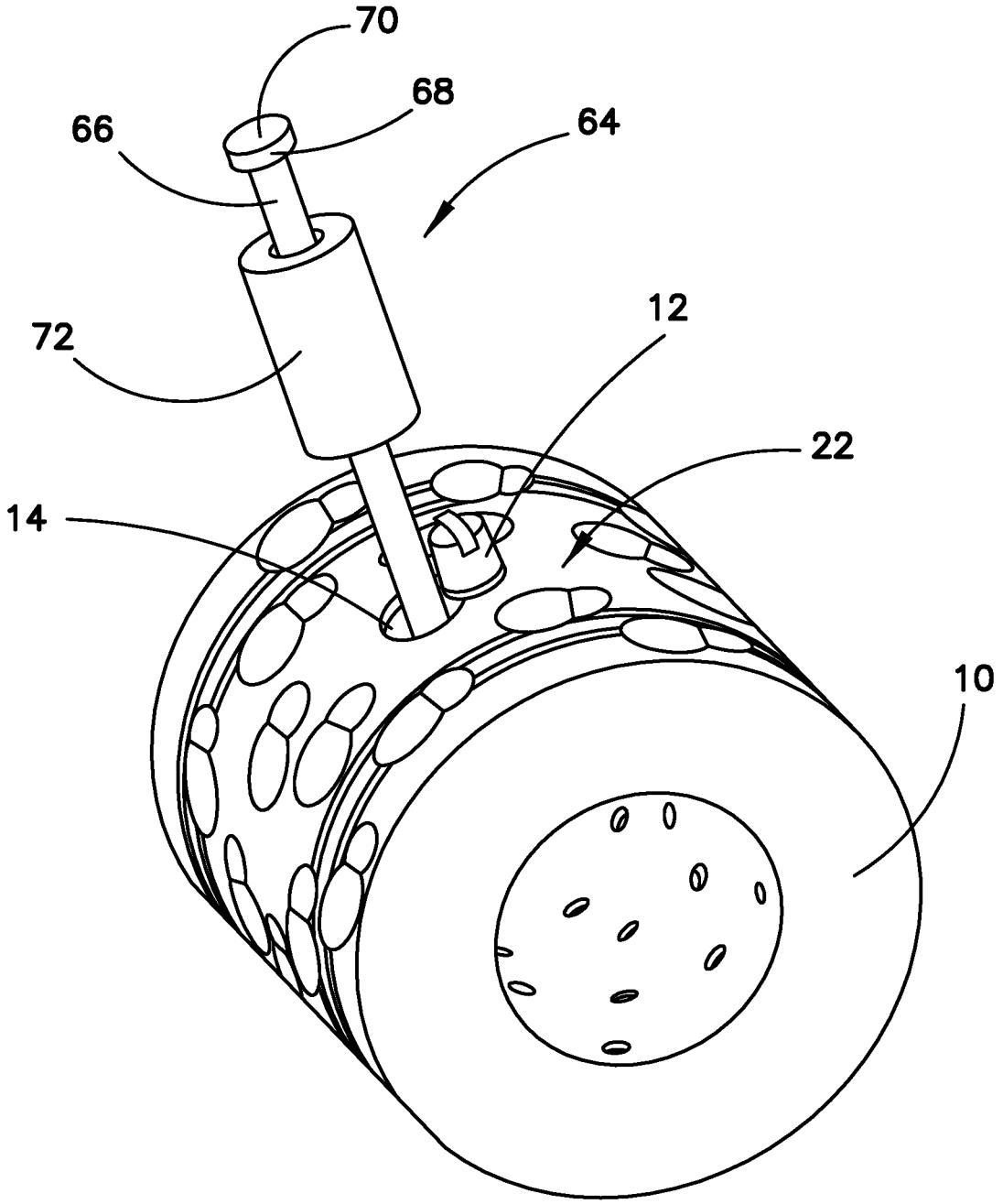
FIG. 5 is a perspective view of a drum with a slide hammer engaged into a retainer to extract the retainer and associated cutting bit from the drum.

FIG. 5 is a perspective view of a drum 10 with a slide hammer 64 engaged into hole 50 of retainer 14 to extract the retainer 14 and associated cutting bit 12 from the drum 10. The slide hammer 64 includes a shaft 66 having a lower end engaging hole 50 of the retainer 14 and an upper end 68 including an enlarged head 70. A slide weight 72 is situated on the shaft 66 so as to be reciprocally movable along the shaft, and, in particular, to repeatedly impact the enlarged head 70. The repeated impact will act to extract the retainer 14 from the recess 18. As the retainer 14 moves outward, an edge of the planar upper surface 42 of the retainer 14 will come in contact with the laterally extending surface 40 located immediately above the retainer engagement feature 26. Consequently, the outward movement of the retainer 14 forces the associated cutting bit 12 from the drum 10.

An alternative to the use of an slide hammer 64 is the engagement of an elongated extraction screw, not shown, in the hole 50 of retainer 14. The elongated extraction screw can have a lower end designed to abut the bottom 15 of recess 18. An impact wrench, or other tool, can then advance the extraction screw, which advance has the effect of backing the retainer 14 out of recess 18. As the retainer 14 moves outward, an edge of the planar upper surface 42 of the retainer 14 comes into contact with the laterally extending surface 40 located immediately above the retainer engagement feature 26. Consequently, the outward movement of the retainer 14 forces the associated cutting bit 12 from the drum 10.

Figure 6:
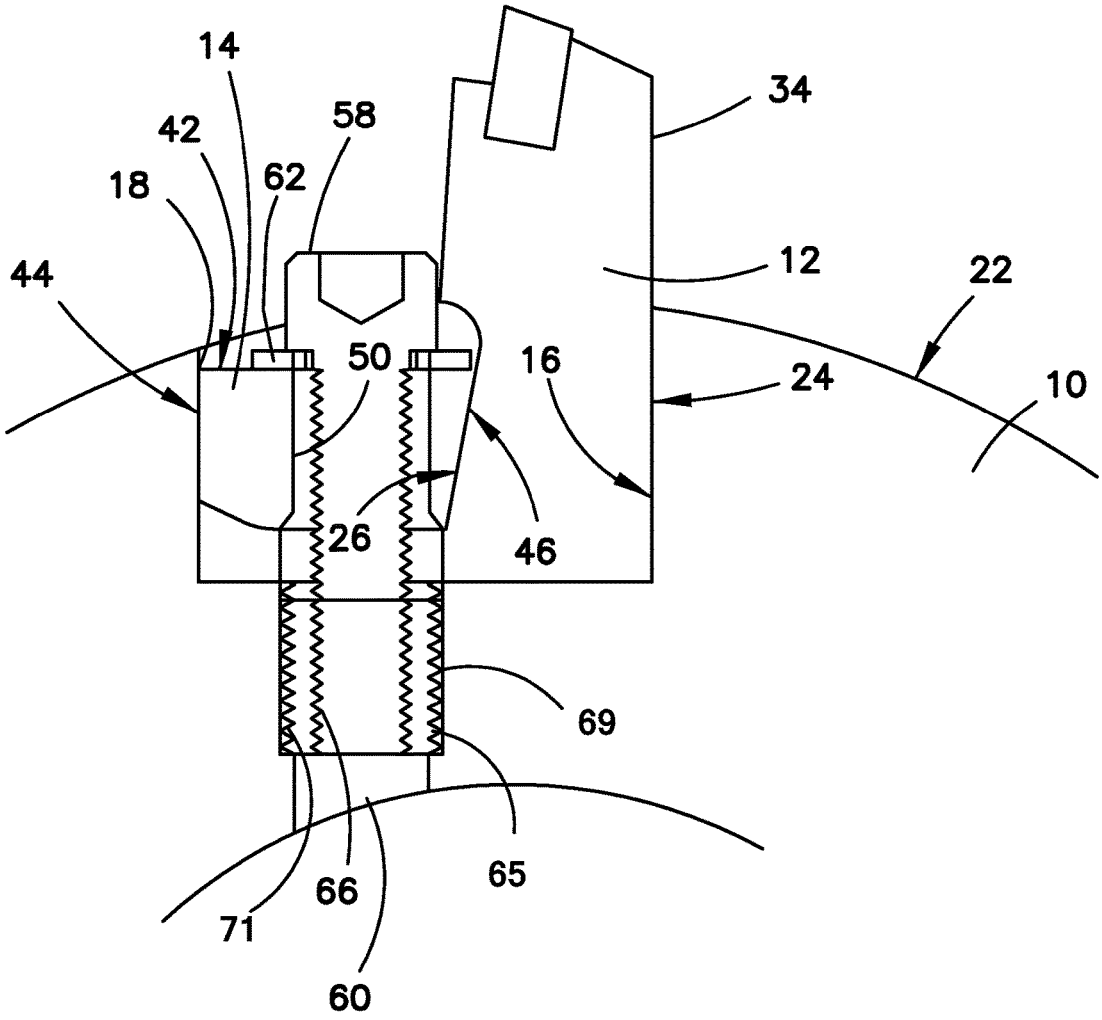
FIG. 6 is a sectional view of a drum similar to FIG. 4 showing a removable insert having internal threads designed to engage the fastener securing the retainer in place.

FIG. 6 is a sectional view of a drum 10 similar to FIG. 4 showing a removable insert 65 having internal threads 66 designed to engage the fastener 58 securing the retainer 14 in place in the recess 18. The removable insert 65 can have an outer engagement surface 69 designed to cooperatively engage a corresponding interior engagement surface 71 in opening 60. The cooperatively engaging surfaces 69 and 71 can be, for example, threads, preferably of a different pitch than the internal threads 66 engaging the fastener 58, and possibly of a hand opposite that of the internal threads 66. The removable character of the insert 65 ensures that the drum 10 can quickly be refurbished in the field, if necessary, in the event of any damage to the fastener engaging threads 66. This avoids the necessity of having to possibly re-tap the threads of opening 60 shown in FIG. 4 in the event of damage to the threads. As in FIG. 4, the pedestal portion 24 of the cutting bit 12 is shown to be dimensioned to match the size of the recess 16, while the upper portion 34 extends above the surface 22 of the drum 10. The side surface 44 of the retainer 14 is dimensioned to match the recess 18, while the vertical dimension of the retainer is such that the planar upper surface 42 is recessed below the surface 22 of the drum 10. The tooth engagement feature 46 of the retainer 14 engages in an abutting arrangement the retainer engagement feature 26 of the tooth or cutting bit 12. The fastener 58 can secure the retainer 14 in the recess 18 so that the tooth engagement feature 46 engages the retainer engagement feature 26 to lock the cutting bit 12 in a desired position with respect to the drum surface 22. The fastener 58 passes freely through the hole 50 in the retainer 14 to engage the internal threaded portion 66 of removable insert 65. The fastener 58 can include a washer 62 to provide a broad bearing surface on the top of the planar upper surface 42 of the retainer 14.

It will be noted from at least FIGS. 1, 5 and 6 that the diameter of the retainer receiving recess 18 is greater than the diameter of the cutting bit receiving recess 16. The relative sizes of the recesses are a matter of design choice, and the relative sizes can be reversed or maintained equal. It will also be noted from at least FIGS. 1, 5 and 6 that the recesses are cylindrical in shape, but again this is a matter of design choice, and other shapes might be used for either or both of the recesses 16, 18, so long as the pedestal 24 of the cutting bit 12 and the retainer 14 are suitably shaped to correspond to the shape and size of the recesses 16, 18. It will also be noted from at least FIGS. 1, 5 and 6 that the recesses 16, 18 are aligned along a circumference line extending around the cylindrical surface 22 of the drum 10, with the retainer 14 in advance of the cutting bit 12. The relative position of the retainer 14 and cutting bit 12 is a matter of design choice. The retainer could be positioned behind or beside the cutting bit so long as the retainer engagement surface 26 and the laterally extending surface 40 on the cutting bit 12 were suitably repositioned. It will be noted from at least FIGS. 1, 2, and 4 that the cutting bit 12 includes a cutting element 36 having an broad upper edge generally parallel to the surface 22 of drum 10. The configuration of the cutting element 36 is also a matter of design choice, and the cutting element can have any desired configuration that is thought to be particularly suitable for the intended use.

Figure 7:
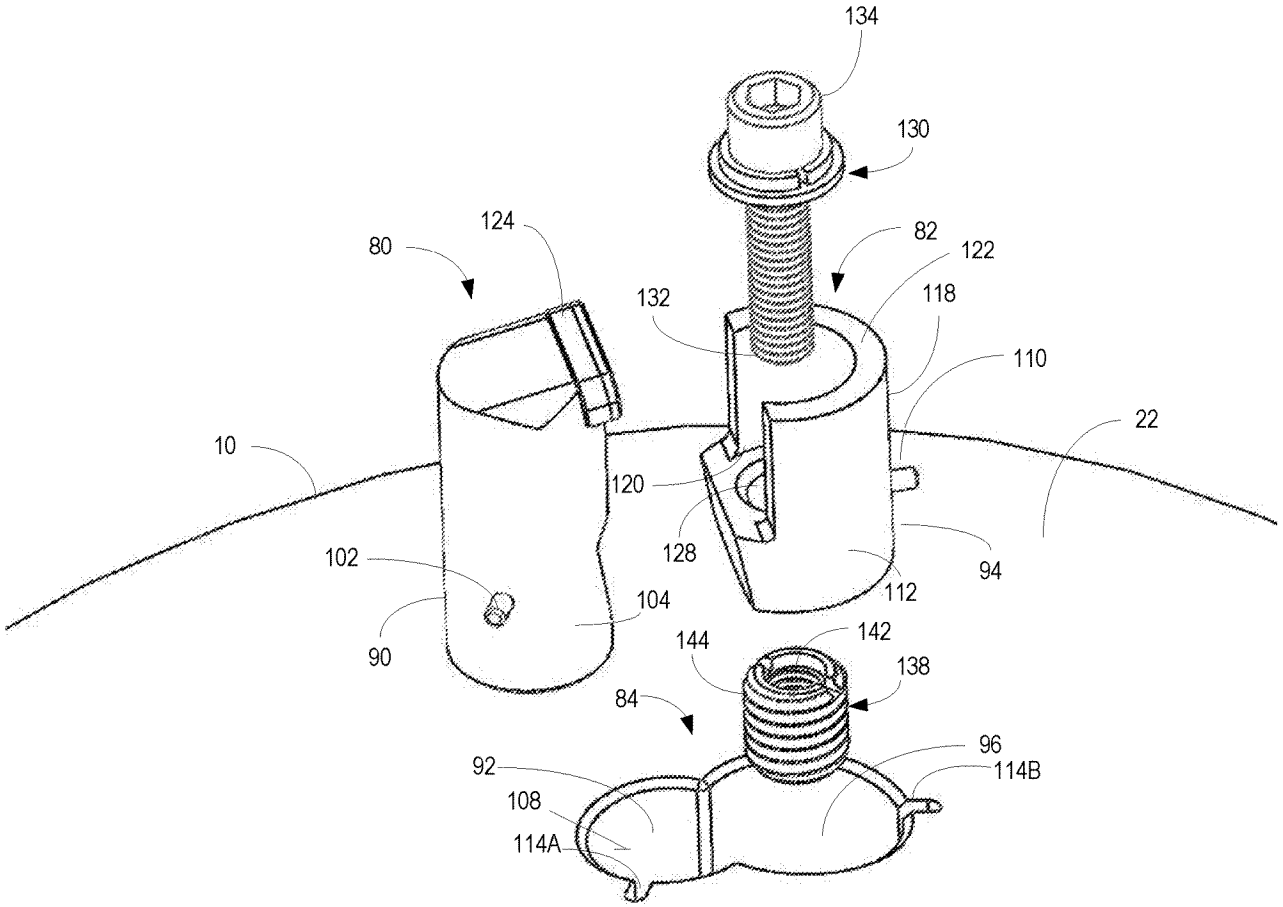
FIG. 7 is a perspective view of a drum that includes an exploded view illustration of an example of a cutting bit and a retainer member.

FIG. 7 is a perspective view of a drum 10 that includes an exploded view illustration of an example of a cutting bit 80 and a retainer 82 included in a cylindrical cutting system that can include any of the previously discussed features of FIGS. 1-6. The milling drum 10 is rotatable about an axis (X) concentric with the cylindrical outer surface 22 of the milling drum 10. As previously discussed, the cylindrical outer surface is formed to include a plurality of recesses, which may also be described as a plurality of pairs of overlapping recesses. Each recess 84 may be formed to receive the cutting bit 80 and the retainer 82. Thus, although not illustrated, the drum 10 can include a predetermined pattern of cutting bit/retainer pairs, such as a helical pattern.

The cutting bit 80 includes a cutting bit base or pedestal 90. A first recess 92 included as part of the recess 84, which forms part of the pair of overlapping recesses, is illustrated as formed to receive the cutting bit base 90. The retainer 82 includes a retainer base 94, and the recess 84 includes a second recess 96. The second recess 96 forms the other part of the pair of overlapping recesses. The second recess 96 is formed to receive the retainer base 94.

In the example illustrated, a first member 102 can extend orthogonally between an outer surface 104 of the cutting bit base 90, and a sidewall 108 formed in the milling drum 10 to define the pair of overlapping recesses. Alternatively, or in addition, a second member 110 can extend orthogonally between an outer surface 112 of the retainer base 94, and a sidewall defining the pair of overlapping recesses. Thus, the cylindrical cutting system can include a member 102 or 110 in either the cutting bit 80 or the retainer 82, or each of the cutting bit 80 and the retainer 82 can include one or more members 102, 110. When the members 102 or 110 are fixedly coupled with one or more of the cutting bit 80 or the retainer 82, the sidewall 108 can be formed to each include a recess in the form of slot(s) to receive the member 102 or 110. The slot(s) may be included in the recess 84, and may, for example, be included as third and fourth recesses 114A and 114B in the first recess 92 and the second recess 96, respectively.

As illustrated in FIG. 7, the slot 114B (fourth recess) included in the second recess may be formed to extend into the sidewall 108 of the milling drum 10 in the cutting direction, and the slot 114A (third recess) included in the first recess 92 may be formed to extend into the sidewall 108 of the milling drum 10 in a direction different from the fourth recess. In other embodiments, the members 102 and/or 110 may extend into slots 114, or other aperture, formed in the milling drum 10 in any other direction. In addition, although only one member 102 and 110 are illustrated in FIG. 7, any number of members, or pins, can be included in either of the cutting bit 80 or the retainer 82.

Alternatively, or in addition, one or more members 102 and 110 may be fixedly coupled with the sidewall 108, and at least one of the retainer base 94 or the cutting bit base 90 may be formed to include a slot or other aperture capable of receiving the member 102 and 110. Thus, in any of the described embodiments, a first end of the member 102 and 110 projects into at least one of the retainer base 94 or the cutting bit base 90, and a second end of the member 102 and 110 protrudes into the sidewall 108.

The member 102 or 110, or pin, may be an alignment member that rotationally retains a position of at least one of the cutting bit base 94 or the retainer base 90 with respect to the sidewall 108. Thus, once the cutting bit 80 and the retainer 82 are positioned in the first recess 92 and the second recess 96, respectively, the alignment of the cutting bit 80 can be maintained in the cutting direction.

The retainer base 94 may extend into the second recess 96, as previously discussed. The retainer 82 may also include a curtain wall 118 extending in a direction opposite the retainer base 94. The curtain wall 118 may have a proximate end 120 of the curtain wall 118 which is fixedly coupled with the retainer base 94. In addition, the curtain wall 118 can extend out of the second recess 96 to a distal end 122 positioned above the cylindrical outer surface of the milling drum 10. The curtain wall 118 may include a wear resistant material in wear areas to protect the curtain wall 118 from wear due to cut material and other loose debris from the workpiece (know as "drift") striking the curtain wall 118 during rotational operation. The wear resistant material can be a carbide composition, and/or sintered polycrystalline diamond.

Figure 8:
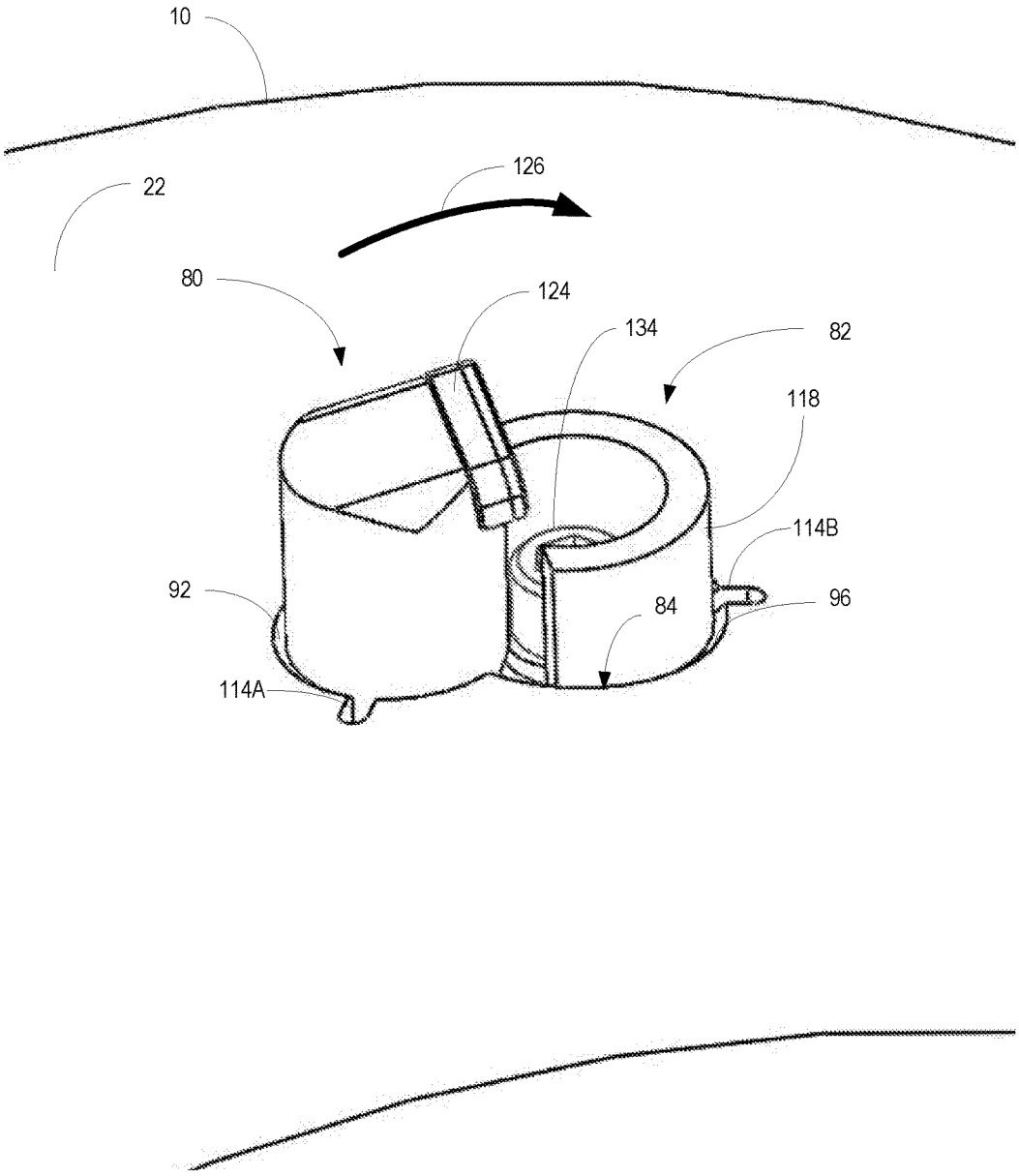
FIG. 8 is a perspective view of the drum of FIG. 7 with the cutting bit and retainer member received in a recess.

FIG. 8 is a perspective view of the drum of FIG. 7 with the cutting bit 80 and retainer member 82 of FIG. 7 received in the recess 84. Accordingly, the cutting bit base 90 is received in the first recess 92 and the member, or pin, 102 projecting from an outer surface of the cutting bit base 94 is received in the third recess 114A formed in the cylindrical drum 10 as part of the first recess 92, and the retainer base 94 is received in the second recess 96 included in the cylindrical drum 10. The first recess 92 and the second recess 96 are positioned such that the retainer member 82 can be positioned in contiguous alignment with the cutting member 80, and a rotational position of the cutting member 80 with respect to the retainer member 82 is maintained by engagement of the pin 102, projecting orthogonally into the third recess 114A, with the cylindrical drum 10. In addition, the pin 110 projecting orthogonally from an outer surface of the retainer base 94 is received in the fourth recess 114B to engage with the cylindrical drum 10. A bit 124 is coupled with the cutting bit base 90, such that when the cutting bit base 90 is received in the first recess 92, the bit 124 is positioned above the exterior outer surface 22 of the cylindrical drum 10. A cutting edge of the bit 124 can be positioned substantially parallel with the rotational axis (X) of the milling drum so as to be positioned within plus and minus five degrees of parallel with the rotational axis (X). In other words, when the cutting bit 80 is received in the first recess 92 a portion of the cutting bit that is the bit 124 is positioned away from an outer surface of the cylindrical milling drum 10 so that the cutting edge of the bit 124 substantially uniformly and substantially squarely cuts a workpiece. The retainer member 82 is contiguously align with the cutting bit 80, and compressively maintains the position of the cutting bit 80 such that the bit 124 is maintained as a cutting surface in the rotational direction (illustrated by arrow 126) of the milling drum 10.

Referring again to FIG. 7, the retainer member 82 can include a fastener 130, such as a bolt, which can extend through a central aperture 128 in the retaining member 82. A first end 132 of the fastener 130 can fixedly couple the retainer member 82 and the cylindrical milling drum 10. The curtain wall 118 can extend above a second end 134 of the fastener 130 to protect the cutting bit 80 and the fastener 130 from wear during rotational operation of the milling drum as best illustrated in FIG. 8. Debris and loose material (which can be described as "drift") removed by the rotating cutting bits 80 extending from the outer surface of the rotating milling drum is deflected away from the cutting bit 80 and the fastener 130 by the curtain wall 118. Alternatively, or in addition, the fastener 130 may be recessed into the drum 10 such that the first end 132 is below the cylindrical surface of the drum. With the fastener 130 recessed into the drum, in some example implementations, the curtain wall 118 may be omitted, and wear resistant material may be used in wear areas of cutting bit 80 that extend above the surface of drum. The wear resistant material can be a carbide composition, and/or sintered polycrystalline diamond.

As illustrated in FIG. 7, the aperture 128 may have an internal engagement feature to receive a removable insert 138. The removable insert 138 may have an internal engagement feature 142, such as the illustrated threads, and an external engagement features 144, such as the illustrated threads, so as to removeably engage with the milling drum via the external engagement feature 144 and with the fastener 130 via the internal engagement feature 142. In other examples, other forms of coupling mechanism may be used to engage the retainer member 82 with the milling drum 10 such that the cutting bit 80 is rigidly maintained in a position above the surface of the milling drum 10.

The foregoing detailed description should be regarded as illustrative rather than limiting, and the following claims, including all equivalents, are intended to define the spirit and scope of this invention

The invention claimed is:

1. A cylindrical cutting system comprising:

a milling drum rotatable about an axis concentric with a cylindrical outer surface of the milling drum, the cylindrical outer surface formed to include a plurality of pairs of overlapping recesses;

a cutting bit comprising a cutting bit base, a first recess of a pair of overlapping recesses included within the plurality of pairs of overlapping recesses formed to receive the cutting bit base;

a retainer comprising a retainer base, a second recess of the pair of overlapping recesses formed to receive the retainer base;

a member extending orthogonally from an outer surface of at least one of the cutting bit base or the retainer base, and also from an outer surface of a sidewall defining the pair of overlapping recesses.

2. The cylindrical cutting system of claim 1, wherein the member is fixedly coupled with the at least one of the retainer base or the cutting bit base, and the sidewall is formed to include a slot to receive the member.

3. The cylindrical cutting system of claim 1, wherein the member is fixedly coupled with the sidewall, and the at least one of the retainer base or the cutting bit base are formed to include a slot to receive the member.

4. The cylindrical cutting system of claim 1, wherein a first end of the member protrudes into the at least one of the retainer base or the cutting bit base, and a second end of the member protrudes into the sidewall.

5. The cylindrical cutting system of claim 1, wherein the member is an alignment member.

6. The cylindrical cutting system of claim 1, wherein the member rotationally retains a position of the at least one of the cutting bit base or the retainer base with respect to the sidewall.

7. The cylindrical cutting system of claim 1, wherein the retainer further comprises a curtain wall extending in a direction opposite the retainer base.

8. The cylindrical cutting system of claim 7, wherein a proximate end of the curtain wall is fixedly coupled with the retainer base, and the curtain wall extends out of the second recess to a distal end positioned above the cylindrical outer surface of the milling drum.

9. A cylindrical cutting system comprising:

a cutting bit base formed to be received in a first recess included in a cylindrical drum, the cutting bit base including a pin projecting from an outer surface of the cutting bit base, the pin formed to be received in a second recess formed in the cylindrical drum as part of the first recess; and a retainer member comprising a retainer base formed to be received in a third recess included in the cylindrical drum, the first recess and the third recess being positioned such that the retainer member can be positioned in contiguous alignment with the cutting bit base, and a rotational position of the cutting bit base with respect to the retainer member is maintained by engagement of the pin, in the second recess, with the cylindrical drum.

10. The cylindrical cutting system of claim 9, wherein the pin is a first pin projecting orthogonally from the outer surface of the cutting bit base, and the retainer member includes a second pin projecting orthogonally from an outer surface of the retainer base, the third recess including a fourth recess in which the second pin is received to engage with the cylindrical drum.

11. The cylindrical cutting system of claim 9, further comprising a bit coupled with the cutting bit base, the bit positioned above an exterior outer surface of the cylindrical drum.

12. The cylindrical cutting system of claim 11, wherein the retainer member comprises a fastener, a first end of the fastener adapted to fixedly couple the retainer member and the cylindrical milling drum, the fastener recessed into the cylindrical milling drum and the bit comprising a wear resistant material used in a wear area of the bit.

13. A cylindrical cutting system comprising:

a cutting bit formed to be received in a recess included in a cylindrical milling drum such that a portion of the cutting bit is positioned away from an outer surface of the cylindrical milling drum;

a retainer member formed to be disposed in the recess included in the cylindrical milling drum to contiguously align with the cutting bit, wherein the retainer member is adapted to compressively maintain a position of the cutting bit in the recess; and at least one pin extending from an outer surface of at least one of the cutting bit or the retainer member, the pin fixedly coupled with one of the cutting bit and the retainer member and formed to be received in the recess and maintain a rotational position of the cutting bit.

14. The cylindrical cutting system of claim 13, wherein the retainer member comprises a fastener and a curtain wall, a first end of the fastener adapted to fixedly couple the retainer member and the cylindrical milling drum, and the curtain wall extending above a second end of the fastener to protect the cutting bit and the fastener from wear.

15. The cylindrical cutting system of claim 14 wherein the first end of the fastener is opposite the second end of the fastener, and the curtain wall includes a wear resistant material in a wear area of curtain wall.

16. The cylindrical cutting system of claim 14, wherein the retainer member includes a base member formed to extend into the recess formed in the cylindrical drum, and the curtain wall extends in an opposite direction.

17. The cylindrical cutting system of claim 16, wherein the fastener is a bolt that longitudinally extends through a central aperture formed in the base member.

18. The cylindrical cutting system of claim 13, wherein the recess includes a first recess adapted to receive a portion of the cutting bit, a second recess adapted to receive the retainer member, and a slot adapted to receive the pin.

19. The cylindrical cutting system of claim 13, wherein a cutting edge of the cutting bit is positioned substantially parallel with a rotational axis of the cylindrical milling drum.

20. The cylindrical cutting system of claim 13, wherein the cutting bit includes a cutting surface comprising sintered polycrystalline diamond.

* * * * *